United States Patent [19]

Burgess

[11] 4,019,078

[45] Apr. 19, 1977

[54] METHOD OF ELECTRODE MOUNTING IN HIGH-PRESSURE SODIUM DISCHARGE LAMP

[75] Inventor: Norman Burgess, London, England

[73] Assignee: Thorn Electrical Industries Limited, London, England

[22] Filed: Oct. 29, 1975

[21] Appl. No.: 626,655

[30] Foreign Application Priority Data

Oct. 30, 1974 United Kingdom ..... 47037/74

[52] U.S. Cl. ..... 313/217; 313/285; 313/290; 313/331

[51] Int. Cl.[2] ..... H01J 61/06

[58] Field of Search ..... 313/217, 331, 285–290

[56] References Cited

UNITED STATES PATENTS

| | | | |
|---|---|---|---|
| 1,647,238 | 11/1927 | Manthorne | 313/285 X |
| 2,521,315 | 9/1950 | Victoreen | 313/290 X |
| 3,038,098 | 6/1962 | O'Neill | 313/285 X |
| 3,474,277 | 10/1969 | Zollweg et al. | 313/221 X |

*Primary Examiner*—Rudolph V. Rolinec
*Assistant Examiner*—Darwin R. Hostetter
*Attorney, Agent, or Firm*—Robert F. O'Connell

[57] ABSTRACT

A high-pressure sodium discharge lamp has a coil electrode wound on a stem which extends axially into a metal tube whose end is sealed into the wall of the lamp envelope. Outside the envelope the tube is rolled or crimped on to the stem and sealed to the stem by brazing.

6 Claims, 1 Drawing Figure

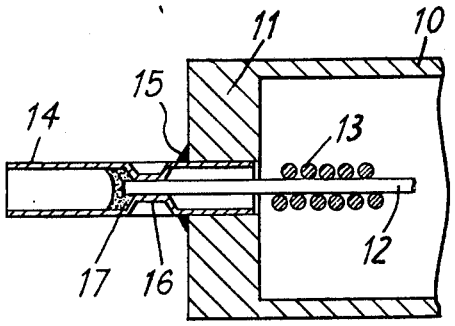
11
10
15
14
13
12
17
16

METHOD OF ELECTRODE MOUNTING IN HIGH-PRESSURE SODIUM DISCHARGE LAMP

The present invention relates to the mounting of the electrodes in a high-pressure sodium discharge lamp.

With such lamps, especially lower wattage lamps of this kind, it is normally necessary to control the operating voltage by means of the temperature of the coolest part of the lamp. The coolest part is often behind the electrodes and its temperature can be governed by the proximity of the electrode, all other variables remaining constant. When the wattage of the lamp is low it may be necessary to mount the electrode very close to the wall of the lamp capsule envelope and to do this without undesirable modification of the electrode itself requires a new method of mounting.

A high-pressure sodium discharge lamp is known from British patent specification No. 1,205,871 in which the discharge envelope is composed of sintered aluminium oxide and niobium tubes are sealed through the end walls of the tubular envelope to support the electrodes, each of which comrises a coil wound on a tungsten pin which is connected to an intermediate element of molybdenum which forms a plug fitting into the inner end of the niobium tube. With such a construction the electrode cannot be brought sufficiently close to the end wall to maintain the required temerature and the risk of transfer of the arc from the electrode to the supporting tube is large.

In accordance with the present invention there is provided a high-pressure sodium discharge lamp having an electrode supported within a discharge envelope by a metal tube which is sealed to the envelope, characterised in that the electrode has a stem which extends freely through the tube to a zone outside the envelope and is there secured and sealed to the inner surface of the tube.

The stem can be secured to the tube by rolling or crimping the tube on to the stem and, if necessary, additional security and sealing can be achieved by brazing the stem to the inner surface of the tube. The electrode may comprise a coil of wire wound around the stem and this can now be placed as close as required to the inner surface of the envelope.

Preferably, the metal tube itself is recessed behind the inner surface of the envelope. This reduces any risk of contact between the electrode coil and the end of the tube and also reduces the risk of "arc-back", i.e. transfer of the arc to the metal tube or its contents which can result in overheating and consequent damage to the envelope. With the end of the tube recessed it is less accessible to the arc and the electrode itself shields the inside of the tube to reduce the risk of arc-back still further.

The invention will be described in more detail with the aid of an example illustrated in the accompanying drawing, the single FIGURE of which is a longitudinal section of one end of a lamp capsule showing the electrode mounting.

The lamp is a high-pressure sodium discharge lamp having an arc tube or discharge envelope of alumina consisting of an alumina tube 10 and a disc-shaped alumina end wall 11 which are sintered together to form a sealed envelope. Within the envelope at each end is mounted an electrode consisting of a stem 12 and an overwound coil 13. The stem 12 and coil 13 are both of refractory metal such as tungsten. The coil 13 may be coated with a material which readily emits electrons. A niobium tube 14 is fitted into an opening in the end wall 11 of the envelope and sealing is completed by melting a ring of sealing glass so that it runs to fill the space between the tube 14 and the end wall 11. There should be sufficient glass applied to leave a fillet 15 after melting has been completed.

The stem 12 of the electrode extends axially through the tube 14 and is spaced from the walls of the tube until in the zone 16, which lies outside the envelope, the niobium tube 14 is rolled or crimped on to the stem to grip it securely. A seal is then made by means of titanium braze 17 which also seals the end of the stem 12 against any leak paths.

I claim:

1. In a high-pressure sodium discharge lamp having a discharge envelope comprising a ceramic tube with ceramic end discs and having at each end of the envelope an electrode supported by a metal tube which is sealed to the end disc, the improvement which comprises for each electrode a stem carrying said electrode, said tube having an inner portion through which said stem extends with clearance and having a portion outside of but close to the end disc, which outer portion is pressed into engagement with and sealed to the said stem.

2. A lamp as claimed in claim 1 in which said outer portion is rolled on to said stem.

3. A lamp as claimed in claim 1 in which the stem is brazed to the tube.

4. A lamp as claimed in claim 1 in which the inner end of said tube is recessed with respect to the inner surface of the end disc.

5. In a high-pressure sodium discharge lamp as claimed in claim 1 the further improvement wherein the said tube has an inner end which extends through the discharge end disc to a region set back with respect to the inner surface of said envelope wall and wherein the outer portion of said tube is rolled or crimped on to said stem and brazed thereto.

6. A lamp as claimed in claim 1 in which the outer portion of said tube is crimped on to said stem.

* * * * *